US011686516B2

(12) United States Patent
Inao et al.

(10) Patent No.: US 11,686,516 B2
(45) Date of Patent: Jun. 27, 2023

(54) REFRIGERANT-AMOUNT DETERMINATION KIT

(71) Applicant: DAIKIN INDUSTRIES, LTD., Osaka (JP)

(72) Inventors: Akihiro Inao, Osaka (JP); Shizuka Sadai, Osaka (JP); Shuji Fujimoto, Osaka (JP); Shinichi Kasahara, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 134 days.

(21) Appl. No.: 16/824,081

(22) Filed: Mar. 19, 2020

(65) Prior Publication Data

US 2020/0300522 A1 Sep. 24, 2020

(30) Foreign Application Priority Data

Mar. 19, 2019 (JP) ..... 2019-051640

(51) Int. Cl.
*F25B 49/02* (2006.01)

(52) U.S. Cl.
CPC ..... *F25B 49/02* (2013.01); *F25B 2700/13* (2013.01); *F25B 2700/1332* (2013.01); *F25B 2700/1353* (2013.01); *F25B 2700/2106* (2013.01); *F25B 2700/21163* (2013.01); *F25B 2700/21175* (2013.01)

(58) Field of Classification Search
CPC ..... F25B 2700/13; F25B 2700/1332; F25B 2700/1353; F25B 2700/2106; F25B 2700/21163; F25B 2700/21175; F25B 49/02
See application file for complete search history.

(56) References Cited

U.S. PATENT DOCUMENTS 6,571,566 B1 * 6/2003 Temple ..... F25B 49/005 62/149
9,168,315 B1 * 10/2015 Scaringe ..... A61K 48/00
9,207,007 B1 * 12/2015 Mowris ..... F25B 49/00
2004/0103673 A1 * 6/2004 Hong ..... F25B 49/00 62/292
2005/0081543 A1 * 4/2005 Oh ..... F25B 13/00 62/198
2006/0137369 A1 * 6/2006 Galante ..... G01K 13/00 62/149
2008/0315000 A1 * 12/2008 Gorthala ..... G05D 22/02 236/94

(Continued)

FOREIGN PATENT DOCUMENTS

JP 5334909 11/2013

*Primary Examiner* — Henry T Crenshaw
(74) *Attorney, Agent, or Firm* — Birch, Stewart, Kolasch & Birch, LLP

(57) ABSTRACT

A refrigerant-amount determination kit includes a sensor and a processor. The sensor is mounted at least temporarily on at least one of a portion of a refrigeration cycle apparatus and the periphery of the refrigeration cycle apparatus. The refrigeration cycle apparatus is an apparatus having a refrigerant circuit that includes a compressor, a condenser, and an evaporator. The processor determines the amount of a refrigerant in the refrigerant circuit based on a detection result detected by the sensor during operation of the refrigeration cycle apparatus.

7 Claims, 8 Drawing Sheets

(56) References Cited

U.S. PATENT DOCUMENTS

| | | | | |
|---|---|---|---|---|
| 2009/0090119 | A1* | 4/2009 | Dietschi | F25D 31/002 239/24 |
| 2010/0107660 | A1* | 5/2010 | Kawano | F25B 45/00 62/77 |
| 2015/0007591 | A1* | 1/2015 | Liu | G01K 13/02 62/77 |
| 2018/0340719 | A1* | 11/2018 | Rona | F25B 49/02 |

* cited by examiner

REFRIGERANT-AMOUNT DETERMINATION KIT

TECHNICAL FIELD

The present disclosure relates to a refrigerant-amount determination kit that determines the amount of a refrigerant of a refrigeration cycle apparatus.

BACKGROUND ART

Conventionally, as disclosed in Patent Document 1 (Specification of Japanese Patent No. 5334909), there is a technology that controls the operational state (condensation temperature or evaporation temperature) of a refrigeration cycle apparatus to be under a constant condition and determines the amount of a refrigerant based on the value of the degree of subcooling or the like. Patent Document 1 (Specification of Japanese Patent No. 5334909) discloses that the refrigerant-amount determination technology is applied to a refrigerant packing operation or the like in the initial stage of equipment installation and that presence/absence of a refrigerant leak is determined based on a result of the refrigerant-amount determination.

SUMMARY OF THE INVENTION

It is, however, nearly impossible to perform refrigerant-amount determination in refrigeration cycle apparatuses loaded with a constant-speed compressor because such refrigeration cycle apparatuses have few sensors and the like although refrigeration cycle apparatuses loaded with an inverter compressor, such as that disclosed in Patent Document 1 (Specification of Japanese Patent No. 5334909), have a large number of sensors that measure the temperature or the pressure of refrigerants. Therefore, in refrigeration cycle apparatuses loaded with a constant-speed compressor, a service of determining a refrigerant amount has not been performed conventionally.

A refrigerant-amount determination kit according to a first aspect includes a sensor and a processor. The sensor is mounted at least temporarily on at least one of a portion of a refrigeration cycle apparatus and a periphery of the refrigeration cycle apparatus. The refrigeration cycle apparatus is an apparatus having a refrigerant circuit that includes a compressor, a condenser, and an evaporator. The processor determines the amount of a refrigerant in the refrigerant circuit based on a detection result detected by the sensor during operation of the refrigeration cycle apparatus.

The refrigerant-amount determination kit according to the first aspect is highly convenient because it is possible to perform refrigerant-amount determination easily even when the refrigerant cycle apparatus is not provided with a sensor required for refrigerant-amount determination.

A refrigerant-amount determination kit according to a second aspect is the refrigerant-amount determination kit of the first aspect, in which the sensor includes a temperature sensor that detects the temperature of a refrigerant flowing in the refrigerant circuit.

In the refrigerant-amount determination kit according to the second aspect, it is possible to perform refrigerant-amount determination with high accuracy by using a refrigerant temperature detected by the sensor.

A refrigerant-amount determination kit according to a third aspect is the refrigerant-amount determination kit of the second aspect, in which the refrigerant-amount determination kit further includes a heat insulation member that covers the periphery of the temperature sensor.

In the refrigerant-amount determination kit according to the third aspect, a refrigerant temperature can be detected with high accuracy, and it is possible to perform refrigerant-amount determination with high accuracy based on a detection result.

A refrigerant-amount determination kit according to a fourth aspect is the refrigerant-amount determination kit of the second aspect or the third aspect, in which the temperature sensor includes at least one of a first sensor group and a second sensor group. The first sensor group includes a first temperature sensor and a second temperature sensor. The first temperature sensor detects the condensation temperature of the refrigerant in the refrigerant circuit. The second temperature sensor detects the temperature of the refrigerant at an outlet of the condenser of the refrigerant circuit. The second sensor group includes a third temperature sensor and a fourth temperature sensor. The third temperature sensor detects the evaporation temperature of the refrigerant in the refrigerant circuit. The fourth temperature sensor detects the temperature of the refrigerant at an outlet of the evaporator of the refrigerant circuit.

In the refrigerant-amount determination kit according to the fourth aspect, it is possible to perform refrigerant-amount determination with high accuracy by utilizing a value of the degree of subcooling or the degree of superheating.

A refrigerant-amount determination kit according to a fifth aspect is the refrigerant-amount determination kit of any one of the first aspect to the fourth aspect, in which the sensor includes an outside-air temperature sensor that detects an outside air temperature at an installation place of the refrigeration cycle apparatus.

In the refrigerant-amount determination kit according to the fifth aspect, it is possible to perform refrigerant-amount determination with high accuracy by further using information on an actually measured outside air temperature.

A refrigerant-amount determination kit according to a sixth aspect is the refrigerant-amount determination kit of any one of the first aspect to the fifth aspect, in which the refrigerant-amount determination kit further includes a transmitter. The transmitter transmits a detection result detected during operation of the refrigeration cycle apparatus by the sensor to the processor.

DESCRIPTION OF EMBODIMENTS

Embodiments of a refrigerant-amount determination kit of the present disclosure will be described.

First Embodiment

A refrigerant-amount determination kit 100 of a first embodiment will be described.

(1) Overall Configuration

Figure 1:
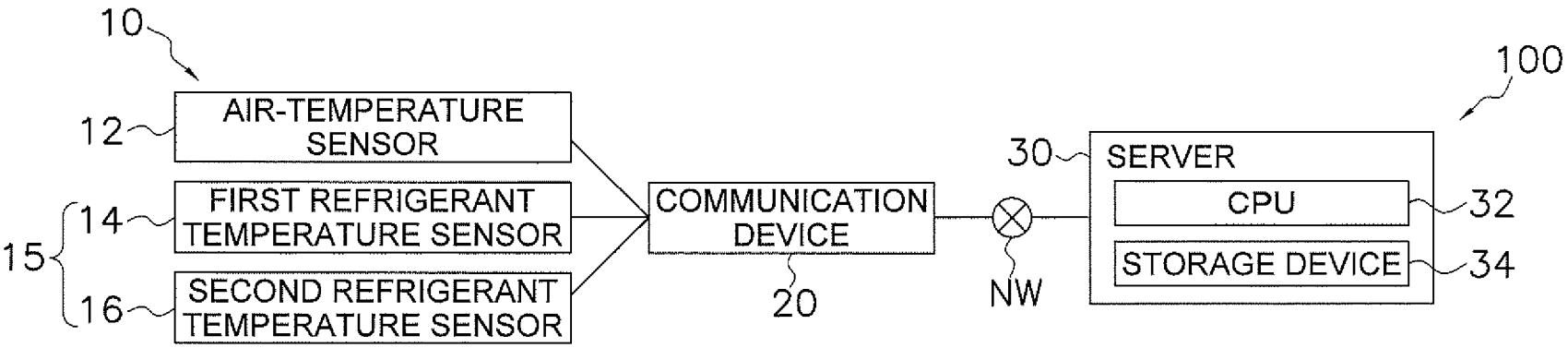
FIG. 1 is a block diagram of a refrigerant-amount determination kit according to a first embodiment of the present disclosure.

The refrigerant-amount determination kit 100 will be described with reference to FIG. 1. FIG. 1 is a block diagram of the refrigerant-amount determination kit 100.

The refrigerant-amount determination kit 100 is a device for determining the amount of a refrigerant enclosed in a refrigerant circuit of a refrigeration cycle apparatus. Here, from the point of view of simplicity of expression, the expression "determines the amount of a refrigerant enclosed in a refrigerant circuit of a refrigeration cycle apparatus" is sometimes alternatively expressed as "determines the refrigerant amount of the refrigeration cycle apparatus". The refrigerant-amount determination kit 100 is a unit that includes at least one sensor 10 and a determination device that determines the amount of a refrigerant enclosed in a refrigerant circuit of a refrigeration cycle apparatus based on a detection result of the sensor 10. The sensor 10 is installed at least temporarily on at least one of the refrigeration cycle apparatus and the periphery of the refrigeration cycle apparatus. In the present embodiment, the determination device is a server 30 connected to the sensor 10 through a network NW, such as the Internet. The detailed configuration and operation of the refrigerant-amount determination kit 100 will be described later.

The refrigerant cycle apparatus that is a target of refrigerant-amount determination of the refrigerant-amount determination kit 100 is a vapor compression type apparatus having a refrigerant circuit that includes a compressor, a condenser, and an evaporator. Examples of the refrigeration cycle apparatus include an air conditioner, a hot water supply apparatus, a floor heating apparatus, and a refrigeration/freezing apparatus. Details of the refrigeration cycle apparatus will be described later by presenting an air conditioner 200 as an example.

The refrigeration cycle apparatus that is a target of refrigerant-amount determination of the refrigerant-amount determination kit 100 is an already-installed existing apparatus. By using the refrigerant-amount determination kit 100, an administrator or the like of the refrigeration cycle apparatus is enabled to easily grasp a refrigerant amount, as necessary, even when the already-installed refrigeration cycle apparatus does not have a sensor required for performing refrigerant-amount determination. The target of refrigerant-amount determination of the refrigerant-amount determination kit 100 is, however, not limited to an existing refrigeration cycle apparatus and may be a new refrigeration cycle apparatus that is newly installed.

In the present embodiment, after the sensor 10 of the refrigerant-amount determination kit 100 is mounted on at least one of the refrigeration cycle apparatus and the periphery of the refrigeration cycle apparatus, the sensor 10 is left in a state of being mounted. In other words, the refrigerant-amount determination kit 100 of the present embodiment is configured to be able, after the sensor 10 is mounted, to determine, at any time, the refrigeration amount of the refrigeration cycle apparatus.

The use form of the refrigerant-amount determination kit 100 is, however, not limited to such a form. For example, the sensor 10 of the refrigerant-amount determination kit 100 may be mounted on at least one of the refrigeration cycle apparatus and the periphery of the refrigeration cycle apparatus only during refrigerant-amount determination. The refrigerant-amount determination kit 100 may be used repeatedly for refrigerant-amount determination of a plurality of refrigeration cycle apparatuses.

(2) Detailed Configuration of Air Conditioner

Figure 2:
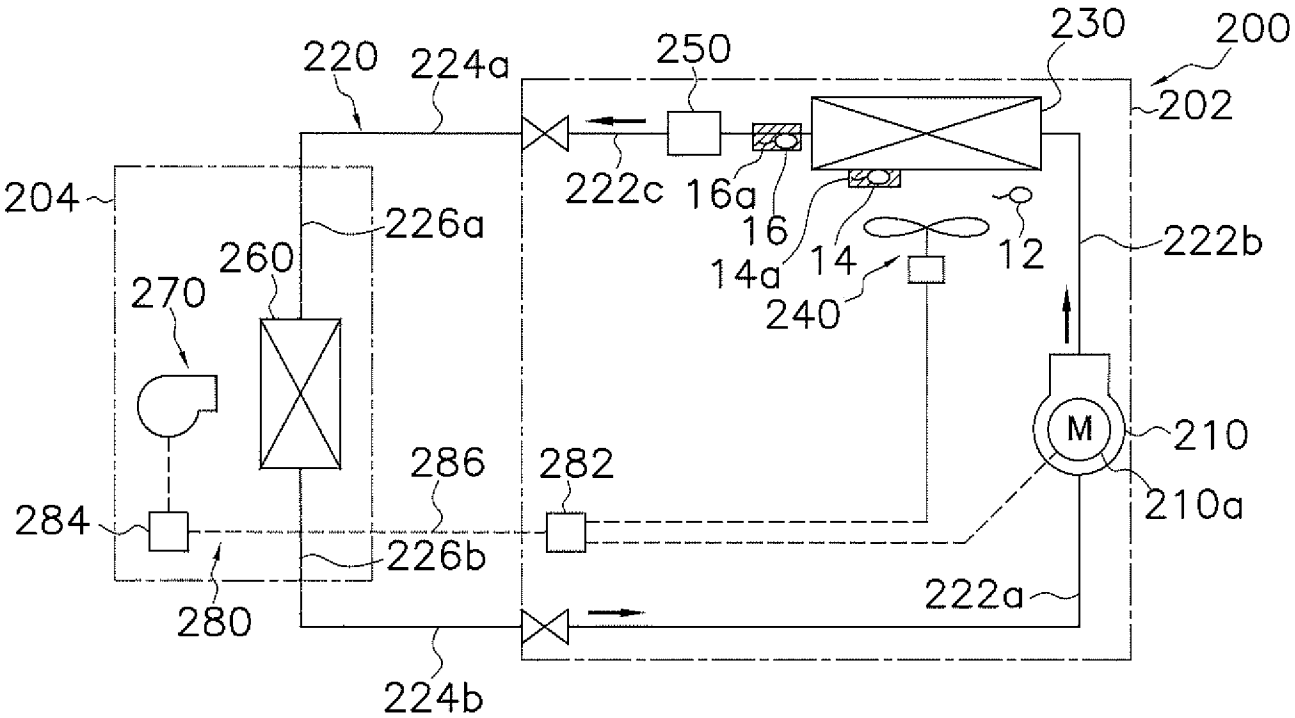
FIG. 2 is a schematic block diagram of an air conditioner that is a target of refrigerant-amount determination of the refrigerant-amount determination kit, illustrating a state in which sensors of the refrigerant-amount determination kit in FIG. 1 are installed in a heat-source-side heat exchanger, a liquid-refrigerant pipe connected to the heat-source-side heat exchanger, and a measurement place of a heat-source air temperature.

The air conditioner 200, which is an example of the refrigeration cycle apparatus that is a target of refrigerant-amount determination of the refrigerant-amount determination kit 100, will be described with reference to FIG. 2. FIG. 2 is a schematic block diagram of the air conditioner 200. An air temperature sensor 12, a first refrigerant temperature sensor 14, and a second refrigerant temperature sensor 16 drawn in FIG. 2 are sensors of the refrigerant-amount determination kit 100 and not sensors originally installed in the air conditioner 200.

The air conditioner 200 is an apparatus that performs cooling of an air conditioned space by utilizing a refrigeration cycle. The air conditioner 200, however, may be an apparatus that performs heating of an air conditioned space in addition to cooling of the air conditioned space or instead of cooling of the air conditioned space. When the air conditioner 200 is an apparatus that performs both cooling and heating of an air conditioned space, a heat source unit 202 (described later) of the air conditioner 200 is provided with a mechanism, such as a four-way switching valve, for switching the flowing direction of a refrigerant.

The air conditioner 200 is provided with, mainly, the one heat source unit 202, one utilization unit 204, a liquid-refrigerant connection pipe 224*a* and a gas-refrigerant connection pipe 224*b*, and a control unit 280 (refer to FIG. 2). The liquid-refrigerant connection pipe 224*a* and the gas-refrigerant connection pipe 224*b* are pipes that connect the heat source unit 202 and the utilization unit 204 to each other (refer to FIG. 2). The control unit 280 controls operation of various devices of the heat source unit 202 and the utilization unit 204.

The air conditioner 200 of the present embodiment includes one heat source unit 202 and one utilization unit 204 each other. The number of the heat source unit 202 and the utilization unit 204 is, however, not limited to one. The air conditioner 200 may include two or more of the heat source units 202 and may include two or more of the utilization units 204. The air conditioner 200 may be an integration-type apparatus in which the heat source unit 202 and the utilization unit 204 are assembled into a single unit.

The heat source unit 202 and the utilization unit 204 are connected to each other via the liquid-refrigerant connection pipe 224*a* and the gas-refrigerant connection pipe 224*b*, thereby constituting a refrigerant circuit 220 (refer to FIG.

2). A refrigerant is enclosed in the refrigerant circuit 220. The refrigerant enclosed in the refrigerant circuit 220 is, for example, a fluorocarbon-based refrigerant, such as R32, but is not limited thereto. The refrigerant circuit 220 has a compressor 210, a heat-source-side heat exchanger 230, an expansion mechanism 250 of the heat source unit 202, and a utilization-side heat exchanger 260 of the utilization unit 204 (refer to FIG. 2).

(2-1) Utilization Unit

The utilization unit 204 is a unit to be installed in an air conditioned space. For example, the utilization unit 204 is a ceiling-embedded unit. The utilization unit 204 is, however, not limited to the ceiling-embedded unit and may be a unit of a ceiling suspension type, a wall mounted type, or a floor installation type.

The utilization unit 204 may be installed in a space other than an air conditioned space. For example, the utilization unit 204 may be installed in an attic, a machine room, a garage, or the like. In this case, an air passage through which air that has exchanged heat with a refrigerant in the utilization-side heat exchanger 260 is supplied from the utilization unit 204 to an air conditioned space is installed. The air passage is, for example, a duct. The type of the air passage is, however, not limited to a duct and is selectable, as appropriate.

The utilization unit 204 has, mainly, the utilization-side heat exchanger 260, a utilization-side fan 270, and a utilization-side control unit 284 (refer to FIG. 2).

(2-1-1) Utilization-Side Heat Exchanger

The utilization-side heat exchanger 260 is a heat exchanger in which heat is exchanged between a refrigerant flowing in the utilization-side heat exchanger 260 and air of an air conditioned space. The utilization-side heat exchanger 260 is, for example, a fin-and-tube heat exchanger that has a plurality of heat transfer tubes and a plurality of fins (not illustrated); however, the type of the heat exchanger is not limited thereto.

The utilization-side heat exchanger 260 is connected at one end to a liquid-refrigerant pipe 226*a* and connected at the other end to a gas-refrigerant pipe 226*b*. The liquid-refrigerant pipe 226*a* is a pipe that is connected at one end to the liquid-refrigerant connection pipe 224*a* and connected at the other end to the utilization-side heat exchanger 260. The gas-refrigerant pipe 226*b* is a pipe connected at one end to the gas-refrigerant connection pipe 224*b* and connected at the other end to the utilization-side heat exchanger 260.

During operation of the air conditioner 200, the refrigerant flows in through the liquid-refrigerant pipe 226*a* to the liquid side of the utilization-side heat exchanger 260, and the refrigerant flows out from the gas side of the utilization-side heat exchanger 260 into the gas-refrigerant pipe 226*b*. In the present embodiment, the utilization-side heat exchanger 260 functions as a refrigerant evaporator.

(2-1-2) Utilization-Side Fan

The utilization-side fan 270 is a mechanism that sucks air of an air conditioned space into a casing (not illustrated) of the utilization unit 204, supplies the air to the utilization-side heat exchanger 260, and blows out the air that has exchanged heat with the refrigerant in the utilization-side heat exchanger 260 into the air conditioned space. The utilization-side fan 270 is, for example, a turbo fan. The type of the utilization-side fan 270 is, however, not limited to the turbo fan and is selectable, as appropriate.

(2-1-3) Utilization-Side Control Unit

The utilization-side control unit 284 has a microcomputer, a memory in which a control program executable by the microcomputer is stored, and the like. Note that the configuration of the utilization-side control unit 284 described here is merely an example, and the function of the utilization-side control unit 284 may be realized by a software, may be realized by a hardware, and may be realized by a combination of a software and a hardware.

The utilization-side control unit 284 is electrically connected to the utilization-side fan 270 (refer to FIG. 2).

The utilization-side control unit 284 is connected, through a transmission line 286, to a heat-source-side control unit 282 of the heat source unit 202 in a state of being capable of performing an exchange of control signals and the like. The utilization-side control unit 284 and the heat-source-side control unit 282 may be communicably connected to each other wirelessly, instead of through a physical communication line. The utilization-side control unit 284 and the heat-source-side control unit 282 cooperate with each other to function as the control unit 280 that controls operation of the air conditioner 200. The control unit 280 will be described later.

(2-2) Heat Source Unit

The heat source unit 202 is disposed outside the air conditioned space. The heat source unit 202 is installed, for example, on a roof floor of a building in which the air conditioner 200 is installed or adjacent to the building.

The heat source unit 202 has, mainly, the compressor 210, the heat-source-side heat exchanger 230, the expansion mechanism 250, a heat-source-side fan 240, and the heat-source-side control unit 282 (refer to FIG. 2).

The heat source unit 202, however, does not necessarily have all of the aforementioned constituent elements; the constituent elements of the heat source unit 202 are selectable, as appropriate. For example, the heat source unit 202 may not include the expansion mechanism 250 as a constituent, and the utilization unit 204, instead of the heat source unit 202, may have a similar expansion mechanism.

The heat source unit 202 has a suction pipe 222*a*, a discharge pipe 222*b*, and a liquid-refrigerant pipe 222*c* (refer to FIG. 2). The suction pipe 222*a* connects the gas-refrigerant connection pipe 224*b* and the suction side of the compressor 210 to each other (refer to FIG. 2). The discharge pipe 222*b* connects the discharge side of the compressor 210 and the gas side of the heat-source-side heat exchanger 230 to each other (refer to FIG. 2). The liquid-refrigerant pipe 222*c* connects the liquid side of the heat-source-side heat exchanger 230 and the liquid-refrigerant connection pipe 224*a* to each other (refer to FIG. 2). The liquid-refrigerant pipe 222*c* is provided with the expansion mechanism 250 (refer to FIG. 2).

(2-2-1) Compressor

The compressor 210 is a device that sucks a low-pressure refrigerant of the refrigeration cycle through the suction pipe 222*a*, compresses the refrigerant with a compression mechanism (not illustrated), and discharges the compressed refrigerant into the discharge pipe 222*b*. In the present embodiment, the heat source unit 202 has one compressor 210; however, the number of the compressors 210 of the heat source unit 202 is not limited to one. The heat source unit 202 may have a plurality of the compressors 210.

The compressor 210 is, for example, a displacement compressor of a rotary type or a scroll type; however, the type of the compressor 210 is not limited thereto. The compression mechanism (not illustrated) of the compressor 210 is driven by a motor 210*a* (refer to FIG. 2). As a result of the compression mechanism (not illustrated) being driven by the motor 210*a*, the refrigerant is compressed by the compression mechanism. In the present embodiment, the motor 210*a* rotates at a constant speed. In other words, the compressor 210 of the present embodiment is a constant-speed compressor.

(2-2-2) Heat-source-Side Heat Exchanger

The heat-source-side heat exchanger 230 is a heat exchanger in which heat is exchanged between the refrigerant flowing in the heat-source-side heat exchanger 230 and air at an installation place of the heat source unit 202. In the present embodiment, the heat-source-side heat exchanger 230 functions as a refrigerant condenser. The heat-source-side heat exchanger 230 is, for example, a fin-and-tube heat exchanger that has a plurality of heat transfer tubes and a plurality of fins (not illustrated); however, the type of the heat-source-side heat exchanger 230 is not limited thereto.

The heat-source-side heat exchanger 230 is connected at an end portion on the liquid side to the liquid-refrigerant pipe 222*c* and connected at an end portion on the gas side to the discharge pipe 222*b*.

During operation of the air conditioner 200, the refrigerant flows in through the discharge pipe 222*b* to the gas side of the heat-source-side heat exchanger 230, and the refrigerant flows out from the liquid-side of the heat-source-side heat exchanger 230 into the liquid-refrigerant pipe 222*c*. In the present embodiment, the heat-source-side heat exchanger 230 functions as a refrigerant condenser.

(2-2-3) Expansion Mechanism

In the refrigerant circuit 220, the expansion mechanism 250 is disposed in the liquid-refrigerant pipe 222*c* between the heat-source-side heat exchanger 230 and the utilization-side heat exchanger 260 (refer to FIG. 2). When the utilization unit 204 has an expansion mechanism similar to the expansion mechanism 250, instead of the expansion mechanism 250 included in the heat source unit 202, the expansion mechanism is disposed in the liquid-refrigerant pipe 226*a* of the utilization unit 204.

The expansion mechanism 250 adjusts the pressure and the flow rate of a refrigerant flowing in the liquid-refrigerant pipe 222*c*. In the present embodiment, the expansion mechanism 250 is a capillary tube. The expansion mechanism 250 is, however, not limited to a capillary tube and may be, for example, an expansion valve of a temperature sensitive cylinder type.

(2-2-4) Heat-Source-Side Fan

The heat-source-side fan 240 is a mechanism that sucks air around the heat source unit 202 into the casing (not illustrated) of the heat source unit 202, supplies the air to the heat-source-side heat exchanger 230, and blows out the air that has exchanged heat with the refrigerant in the heat-source-side heat exchanger 230 to the outside of the casing of the heat source unit 202. The heat-source-side fan 240 is, for example, a propeller fan. The type of the fan of the heat-source-side fan 240 is, however, not limited to the propeller fan and is selectable, as appropriate.

(2-2-5) Heat-Source-Side Control Unit

The heat-source-side control unit 282 has a microcomputer, a memory in which a control program executable by the microcomputer is stored, and the like. Note that the configuration of the heat-source-side control unit 282 described here is merely an example, and the function of the utilization-side control unit 284 may be realized by a software, may be realized by a hardware, or may be realized by a combination of a software and a hardware.

The heat-source-side control unit 282 is electrically connected to the compressor 210 and the heat-source-side fan 240 (refer to FIG. 2).

The heat-source-side control unit 282 is connected, through a transmission line 286, to the utilization-side control unit 284 of the utilization unit 204 in a state of being capable of performing an exchange of control signals and the like. The heat-source-side control unit 282 and the utilization-side control unit 284 cooperate with each other to function as the control unit 280 that controls operation of the air conditioner 200. The control unit 280 will be described later.

(2-3) Refrigerant Connection Pipe

The air conditioner 200 has, as connection pipes that connect the utilization unit 204 and the heat source unit 202 to each other, the liquid-refrigerant connection pipe 224*a* and the gas-refrigerant connection pipe 224*b*. The liquid-refrigerant connection pipe 224*a* and the gas-refrigerant connection pipe 224*b* are pipes that are to be constructed at an installation site of the air conditioner 200 during installation of the air conditioner 200. As the liquid-refrigerant connection pipe 224*a* and the gas-refrigerant connection pipe 224*b*, pipes of various lengths and diameters are used depending on an installation place, installation conditions such as a combination of the heat source unit 202 and the utilization unit 204, and the like.

(2-4) Control Unit

The control unit 280 is constituted by the heat-source-side control unit 282 of the heat source unit 202 and the utilization-side control unit 284 of the utilization unit 204 being communicably connected to each other through the transmission line 286. In the control unit 280, the microcomputers of the heat-source-side control unit 282 and the utilization-side control unit 284 control operation of the air conditioner 200 by executing the programs stored in the memories. Note that the configuration of the control unit 280 described here is merely an example, and the control unit 280 may be realized by a software, may be realized by a hardware, and may be realized by a combination of a software and a hardware.

In the present embodiment, the heat-source-side control unit 282 and the utilization-side control unit 284 constitute the control unit 280. The configuration of the control unit 280 is, however, not limited to such a form. For example, in addition to the heat-source-side control unit 282 and the utilization-side control unit 284 or instead of the heat-source-side control unit 282 and the utilization-side control unit 284, the air conditioner 200 may have a controller that realizes part of or all of the function of the control unit 280 described below.

As illustrated in FIG. 2, the control unit 280 is electrically connected to the compressor 210 and various devices of the heat source unit 202 and the utilization unit 204 including the heat-source-side fan 240 and the utilization-side fan 270.

The control unit 280 is communicably connected to, for example, a thermostat (not illustrated). The thermostat is a temperature controller of the air conditioned space and is a device that transmits an operation command and a stop command of operation to the air conditioner 200 in accordance with the temperature of the air conditioned space. For example, the thermostat transmits the operation command to the air conditioner 200 when the temperature of the air conditioned space is higher than a first temperature and transmits the stop command to the air conditioner 200 when the temperature of the air conditioned space is lower than a second temperature. The second temperature is a temperature lower than the first temperature. On the basis of a command transmitted from the thermostat, the control unit 280 controls operation of the various devices of the air conditioner 200 such as the compressor 210, the heat-source-side fan 240 and the utilization-side fan 270.

The control unit 280 may stop the operation of the air conditioner 200 in response to, in addition to or instead of the command from the thermostat, an operation of a user to an operation switch (not illustrated).

During operation of the air conditioner 200, the control unit 280 operates the compressor 210, the heat-source-side fan 240, and the utilization-side fan 270. In this air conditioner 200, the number of rotations of the motor 210*a* of the compressor 210 is constant.

During operation of the air conditioner 200, the refrigerant flows in the refrigerant circuit 220 as follows.

When the compressor 210 is started, a low-pressure gas refrigerant of the refrigeration cycle is sucked into the compressor 210 and compressed in the compressor 210, thereby becoming a high-pressure gas refrigerant of the refrigeration cycle. The high-pressure gas refrigerant is sent to the heat-source-side heat exchanger 230 and condensed by exchanging heat with a heat-source air supplied by the heat-source-side fan 240, thereby becoming a high-pressure liquid refrigerant. The high-pressure liquid refrigerant flows in the liquid-refrigerant pipe 222*c*, becomes a gas-liquid two-phase state refrigerant by being decompressed in the expansion mechanism 250 to a pressure close to a suction pressure of the compressor 210, and is sent to the utilization unit 204. The gas-liquid two-phase state refrigerant that has been sent to the utilization unit 204 evaporates in the utilization-side heat exchanger 260 by exchanging heat with air of the air conditioned space supplied to the utilization-side heat exchanger 260 by the utilization-side fan 270, thereby becoming a low-pressure gas refrigerant. The low-pressure gas refrigerant is sent to the heat source unit 202 via the gas-refrigerant connection pipe 224*b* and sucked into the compressor 210. The temperature of the air supplied to the utilization-side heat exchanger 260 decreases by exchanging heat with the refrigerant flowing in the utilization-side heat exchanger 260, and the air cooled in the utilization-side heat exchanger 260 is blown out into the air conditioned space.

(3) Refrigerant-Amount Determination Kit

The refrigerant-amount determination kit 100 has, mainly, the sensor 10, a communication device 20, and the server 30. Preferably, the refrigerant-amount determination kit 100 further has heat insulation members 14*a* and 16*a*.

(3-1) Sensor

The sensor 10 includes the air temperature sensor 12, the first refrigerant temperature sensor 14, and the second refrigerant temperature sensor 16. The air temperature sensor 12 is a sensor that measures the temperature of heat-source air around the heat source unit 202. The first refrigerant temperature sensor 14 and the second refrigerant temperature sensor 16 are sensors that measure the temperature of the refrigerant. Hereinafter, the first refrigerant temperature sensor 14 and the second refrigerant temperature sensor 16 are sometimes collectively referred to as a first sensor group 15. The air temperature sensor 12, the first refrigerant temperature sensor 14, and the second refrigerant temperature sensor 16 are, for example, thermistors.

The air temperature sensor 12, the first refrigerant temperature sensor 14, and the second refrigerant temperature sensor 16 are communicably connected to the communication device 20. The air temperature sensor 12, the first refrigerant temperature sensor 14, and the second refrigerant temperature sensor 16 each measures the temperature of a measurement target and transmits a measurement result to the communication device 20. For example, the air temperature sensor 12, the first refrigerant temperature sensor 14, and the second refrigerant temperature sensor 16 periodically measure the temperature of a measurement target and transmit measurement results to the communication device 20. For example, the air temperature sensor 12, the first refrigerant temperature sensor 14, and the second refrigerant temperature sensor 16 measure the temperature of the measurement target once per one minute and transmits measurement results to the communication device 20.

The air temperature sensor 12 is mounted on the periphery of the heat source unit 202 of the air conditioner 200. The air temperature sensor 12 may be mounted at an air intake port of the casing (not illustrated) of the heat source unit 202 of the air conditioner 200. The air temperature sensor 12 measures the temperature of heat-source air. In other words, the air temperature sensor 12 measures the temperature of air around the heat source unit 202. In the present embodiment, the air temperature sensor 12 detects the temperature of outside air at the installation place of the air conditioner 200.

The first refrigerant temperature sensor 14 and the second refrigerant temperature sensor 16 constituting the first sensor group 15 are each mounted on a portion of the air conditioner 200. The first refrigerant temperature sensor 14 and the second refrigerant temperature sensor 16 are mounted on the air conditioner 200 by using, for example, plate springs as metal fixtures. The fixing method is, however, not limited thereto. The first refrigerant temperature sensor 14 and the second refrigerant temperature sensor 16 detect the temperature of a refrigerant flowing in the refrigerant circuit 220 of the air conditioner 200.

In the present embodiment, the first refrigerant temperature sensor 14 is mounted on the heat-source-side heat exchanger 230 (refer to FIG. 2). For example, the first refrigerant temperature sensor 14 is mounted on a heat transfer tube (not illustrated) of the heat-source-side heat exchanger 230 (refer to FIG. 2). The first refrigerant temperature sensor 14 measures the temperature of the refrigerant flowing in the heat-source-side heat exchanger 230. In other words, the first refrigerant temperature sensor 14 detects the condensation temperature of the refrigerant in the refrigerant circuit 220.

In the present embodiment, the second refrigerant temperature sensor 16 is mounted, in the liquid-refrigerant pipe 222*c* of the heat source unit 202, on the upstream side of the expansion mechanism 250 in a refrigerant flowing direction in the refrigerant circuit 220 (refer to FIG. 2). In other words, the second refrigerant temperature sensor 16 is mounted on a portion of the liquid-refrigerant pipe 222*c*, the portion connecting the heat-source-side heat exchanger 230 and the expansion mechanism 250 to each other. The second refrigerant temperature sensor 16 detects the temperature of the refrigerant of the refrigerant circuit 220 at an outlet of the heat-source-side heat exchanger 230 as a condenser.

The first refrigerant temperature sensor 14 is preferably covered by the heat insulation member 14*a* to reduce direct contact between a temperature detection portion of the first refrigerant temperature sensor 14 and peripheral air and thereby reduce an influence applied on the measurement of the first refrigerant temperature sensor 14 by peripheral air. The second refrigerant temperature sensor 16 is preferably covered by the heat insulation member 16*a* to reduce direct contact between a temperature detection portion of the second refrigerant temperature sensor 16 and peripheral air and to thereby reduce an influence applied on the measurement of the second refrigerant temperature sensor 16 by the peripheral air. As the material of the heat insulation member 14*a* and the heat insulation member 16*a*, for example, expanded plastic is used. The material is, however, not limited thereto.

(3-2) Communication Device

The communication device 20 is a unit that transmits data detected by the air temperature sensor 12, the first refrigerant temperature sensor 14, and the second refrigerant temperature sensor 16 to the server 30. In other words, the communication device 20 functions as a gateway that performs relay processing between the sensor 10 and the server 30.

The communication device 20 is communicably connected to the sensor 10 through, for example, a wireless network, such as wireless LAN, Bluetooth (registered trademark), or the like. The communication device 20 and the sensor 10, however, do not necessarily communicate with each other wirelessly and may be communicably connected to each other by wire. The communication device 20 receives measurement data transmitted by the air temperature sensor 12, the first refrigerant temperature sensor 14, and the second refrigerant temperature sensor 16.

The communication device 20 is communicably connected to the server 30 through the network NW such as the Internet. The communication device 20 transmits measurement data transmitted by the air temperature sensor 12, the first refrigerant temperature sensor 14, and the second refrigerant temperature sensor 16 to the server 30 successively. Alternatively, the communication device 20 may transmit the measurement data transmitted by the air temperature sensor 12, the first refrigerant temperature sensor 14, and the second refrigerant temperature sensor 16 collectively, as appropriate. For example, the communication device 20 may transmit measurement data transmitted every one minute by the air temperature sensor 12, the first refrigerant temperature sensor 14, and the second refrigerant temperature sensor 16 to the server 30 collectively every one hour.

In the present embodiment, the refrigerant-amount determination kit 100 has the communication device 20 separately from the sensor 10 and transmits measurement data of the air temperature sensor 12, the first refrigerant temperature sensor 14, and the second refrigerant temperature sensor 16 to the server 30 via the communication device 20. The configuration of the refrigerant-amount determination kit 100 is, however, not limited thereto. Some or all of the air temperature sensor 12, the first refrigerant temperature sensor 14, and the second refrigerant temperature sensor 16 may be devices directly connectable to the network NW, such as the Internet, and may transmit the measurement data directly to the server 30. In other words, some or all of the air temperature sensor 12, the first refrigerant temperature sensor 14, and the second refrigerant temperature sensor 16 may have a communication device capable of directly communicating with the server 30 through the network NW.

(3-3) Server

The server 30 is a computer connected to the sensor 10 through the network NW and the communication device 20. The server 30 may be a single computer or may be constituted by a plurality of computers.

The server 30 functions as a determination device that determines, in response to a CPU 32 executing a program stored in a storage device 34, the amount of the refrigerant in the refrigerant circuit 220 based on a detection result detected by the sensor 10 during operation of the air conditioner 200. In the present embodiment, the server 30 functions as a determination device in the single refrigerant-amount determination kit 100. The server 30, however, may function as a determination device in a plurality of refrigerant-amount determination kits.

Figure 3:
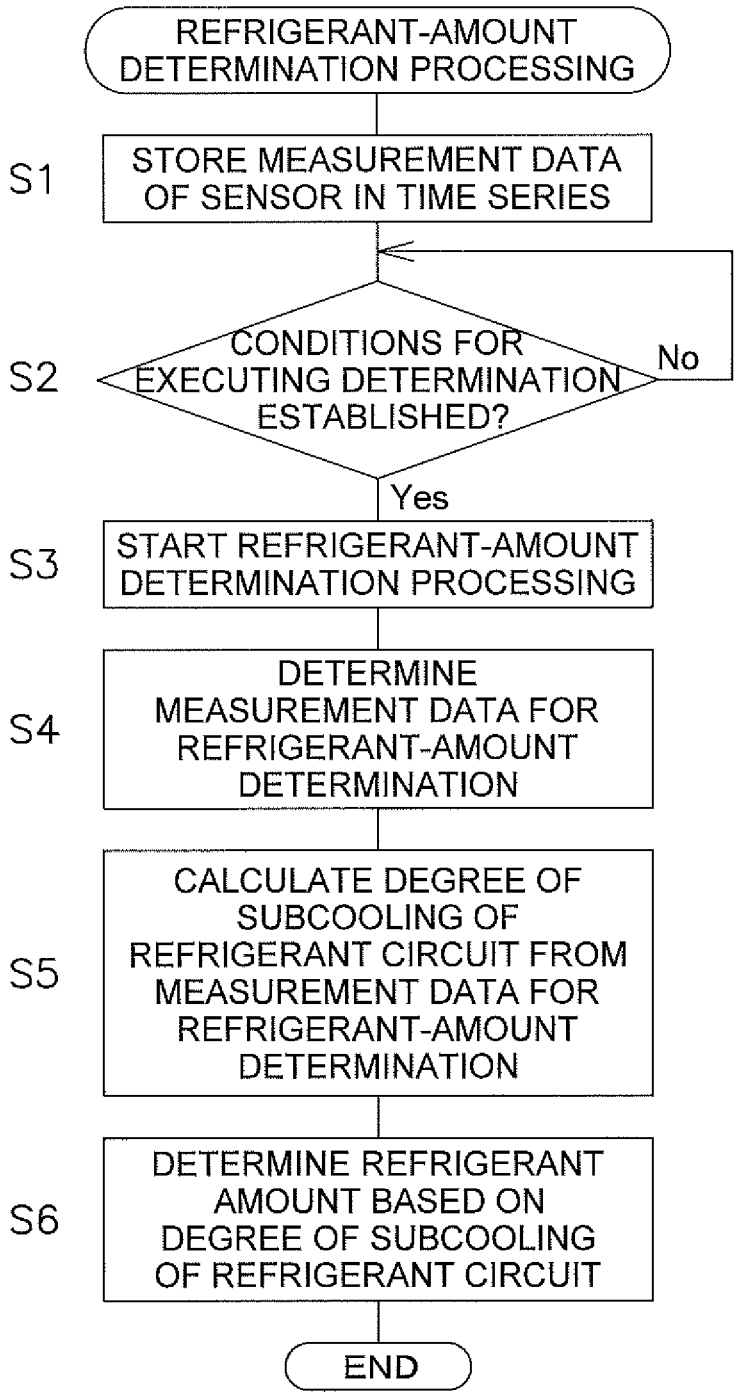
FIG. 3 is an example of the flowchart of processing of refrigerant-amount determination of an air conditioner by the refrigerant-amount determination kit in FIG. 1.

Operation of the server 30 as a determination device will be described with reference to the flowchart in FIG. 3.

In the server 30, the measurement data of the air temperature sensor 12, the first refrigerant temperature sensor 14, and the second refrigerant temperature sensor 16 transmitted from the communication device 20 is stored as time-series data in the storage device 34 (step S1).

Next, when determined that conditions for executing refrigerant-amount determination are established (Yes in the step S2), the server 30 starts determination of the amount of the refrigerant in the refrigerant circuit 220 of the air conditioner 200 (step S3).

The server 30 determines that the conditions for executing refrigerant-amount determination are established, for example, at a following case. The server 30 determines that the conditions for executing refrigerant-amount determination are established, for example, at fixed intervals. Specifically, the server 30 determines that the conditions for executing refrigerant-amount determination are established, for example, every time point when three months have elapsed after a last refrigerant-amount determination. The server 30 may determine that the conditions for executing refrigerant-amount determination are established, for example, when received an execution instruction of a user of the refrigerant-amount determination kit 100 for refrigerant-amount determination processing. The execution instruction of the user is transmitted to the server 30 from, for example, a computer or a mobile device capable of communicating with the server 30 through the Internet.

Next, the server 30 determines the measurement data to be used in refrigerant-amount determination, for example, as follows (step S4).

First, the server 30 identifies measurement data during operation of the air conditioner 200 among measurement data of the air temperature sensor 12, the first refrigerant temperature sensor 14, and the second refrigerant temperature sensor 16 during a latest predetermined period, the measurement data being stored in the storage device 34. For example, the server 30 identifies the measurement data during operation of the air conditioner 200 among measurement data of the sensors 12, 14, and 16 during latest one hour, the measurement data being stored in the storage device 34. For example, the server 30 determines the measurement data of the sensors 12, 14, and 16 at a time point when a temperature measured by the first refrigerant temperature sensor 14 is higher than a temperature measured by the air temperature sensor 12 by a predetermined temperature or more as the measurement data during operation of the air conditioner 200. The method by which the server 30 identifies measurement data during operation of the air conditioner 200 among the measurement data of the sensors 12, 14, and 16 is merely an example. For example, the server 30 may determine the measurement data of the sensors 12, 14, and 16 at a time point when a temperature measured by the second refrigerant temperature sensor 16 is higher than a temperature measured by the air temperature sensor 12 by a predetermined temperature or more as measurement data during operation of the air conditioner 200. In addition, the server 30 may acquire signals of an operation command and a stop command from the thermostat that transmits the operation command and the stop command to the air conditioner 200, and the server 30 may identify the measurement data of the sensors 12, 14, and 16 during operation of the air conditioner 200 based on the signals.

Further, the server 30 identifies measurement data of the sensors 12, 14, and 16 during stable operation among the measurement data of the sensors 12, 14, and 16 during operation of the air conditioner 200. Here, "during stable operation" means a period during which a condensation temperature measured by the first refrigerant temperature sensor 14 or the temperature of a refrigerant measured by the second refrigerant temperature sensor 16 has little fluctuation. The server 30 determines the measurement data of the sensors 12, 14, and 16 during stable operation of the air conditioner 200 as measurement data of the sensors 12, 14, and 16 to be used in refrigerant-amount determination.

Next, the server 30 calculates the degree of subcooling in the refrigeration cycle by using a measurement value of the first refrigerant temperature sensor 14 and a measurement value of the second refrigerant temperature sensor 16 in the air conditioner 200 during stable operation (Step S5). Specifically, the server 30 calculates the degree of subcooling by subtracting the measurement value of the second refrigerant temperature sensor 16 from the measurement value of the first refrigerant temperature sensor 14. When the measurement data of the sensors 12, 14, and 16 during stable operation of the air conditioner 200 includes measurement data at a plurality of time points, an average value, an intermediate value, or the like of the degrees of subcooling at the plurality of time points may be calculated as the degree of subcooling.

Next, the server 30 determines the refrigerant amount of the refrigerant circuit 220 based on an outside air temperature, which is a measurement value of the air temperature sensor 12 during stable operation of the air conditioner 200, and the degree of subcooling calculated in the step S5 (Step S6). When the measurement data of the sensors 12, 14, and 16 during stable operation of the air conditioner 200 includes measurement data at a plurality of time points, the server 30 may use, as the outside air temperature, an average value, an intermediate value, or the like of outside air temperatures at the plurality of time points. For example, when the measurement data of the sensors 12, 14, and 16 during stable operation of the air conditioner 200 includes measurement data at a plurality of time points, the server 30 may determine the refrigerant amount of the refrigerant circuit 220 based on the average value of outside air temperatures at the plurality of time points and the average value of the degrees of subcooling at the plurality of time points.

An example of the refrigerant-amount determination method will be described in detail.

The storage device 34 of the server 30 stores a table or a formula in which the outside air temperature and a reference degree of subcooling of the air conditioner 200, which is a degree of subcooling when the refrigerant amount of the refrigerant circuit 220 is proper, are in association with each other. For example, the table or formula in which the outside air temperature and the reference degree of subcooling are in association with each other may be theoretically calculated, or may be obtained based on a result of operation using an experimental apparatus of the air conditioner. The table or the formula in which the outside air temperature and the reference degree of subcooling are in association with each other may be generated by the server 30 based on the data that has been collected by using the sensor 10 during the past actual operation of the air conditioner 200 for which evaluation of the refrigerant amount is to be performed. The table or the formula in which an outside air temperature and the reference degree of subcooling are in association with each other may be generated by the server 30 based on the data of past actual operation of an air conditioner that differs from the air conditioner 200 for which evaluation of the refrigerant amount is to be performed.

The server 30 determines that the refrigerant amount of the refrigerant circuit 220 is small, for example, when the degree of subcooling calculated in the step S5 is smaller than the value of (reference degree of subcooling—tolerance). When the degree of subcooling calculated in the step S5 is more than or equal to the value of (reference degree of subcooling—tolerance), the server 30 determines that the refrigerant amount of the refrigerant circuit 220 is a proper amount.

When determined that the refrigerant amount of the air conditioner 200 is small, the server 30 preferably reports that the refrigerant amount of the air conditioner 200 is small to an operator of the refrigerant-amount determination kit 100, a user of the air conditioner 200, or the like. For example, the server 30 displays on a display (not illustrated) information reporting a shortage of the refrigerant amount. The server 30 may report the shortage of the refrigerant amount on a portable terminal or the like held by an operator of the refrigerant-amount determination kit 100 or a user of the air conditioner 200.

The aforementioned flow of refrigerant-amount determination processing is merely an example. For example, according to the above description, the server 30 performs refrigerant-amount determination by using previously acquired measurement data of the sensors 12, 14, and 16. As an alternative to this, the server 30 may perform refrigerant-amount determination by using measurement data of the sensors 12, 14, and 16 acquired after the conditions for executing the determination are established (after Yes is determined in the step S2).

(4) Features (4-1)

The refrigerant-amount determination kit 100 of the first embodiment includes the sensor 10 and the server 30 as an example of the determination device. The sensor 10 is mounted at least temporarily on at least one of a portion of the air conditioner 200 and the periphery of the air conditioner 200. The air conditioner 200 is an apparatus that has the refrigerant circuit 220 including the compressor 210, the heat-source-side heat exchanger 230 as a condenser, and the utilization-side heat exchanger 260 as an evaporator. The server 30 determines the amount of the refrigerant in the refrigerant circuit 220 based on a detection result detected by the sensor 10 during operation of the air conditioner 200.

The refrigerant-amount determination kit 100 of the present embodiment is highly convenient because it is possible to perform refrigerant-amount determination easily even when the sensor 10 required for the refrigerant-amount determination is not provided in the air conditioner 200.

(4-2)

In the refrigerant-amount determination kit 100 of the first embodiment, the sensor 10 includes the first refrigerant temperature sensor 14 and the second refrigerant temperature sensor 16 that detect the temperature of the refrigerant flowing in the refrigerant circuit 220.

In the refrigerant-amount determination kit 100 of the present embodiment, it is possible to perform refrigerant-amount determination with high accuracy by using a refrigerant temperature detected by the sensor 10.

(4-3)

The refrigerant-amount determination kit 100 of the first embodiment includes the heat insulation members **14*a* and 16*a* that cover the peripheries of the first refrigerant temperature sensor 14 and the second refrigerant temperature sensor 16**.

In the refrigerant-amount determination kit 100 of the present embodiment, accurate detection of the refrigerant temperature is achieved, and it is possible to perform refrigerant-amount determination with high accuracy based on the detection result.

(4-4)

In the refrigerant-amount determination kit 100 of the first embodiment, the sensor 10 includes the first sensor group 15. The first sensor group 15 includes the first refrigerant temperature sensor 14 and the second refrigerant temperature sensor 16. The first refrigerant temperature sensor 14 detects the condensation temperature of the refrigerant in the refrigerant circuit 220. The second refrigerant temperature sensor 16 detects the temperature of the refrigerant at the outlet of the heat-source-side heat exchanger 230, which functions as the condenser of the refrigerant circuit 220.

In the refrigerant-amount determination kit 100 of the present embodiment, it is possible to perform refrigerant-amount determination with high accuracy by utilizing the value of the degree of subcooling.

In particular, in the refrigerant-amount determination kit 100 of the first embodiment, the sensor 10 includes the air temperature sensor 12 that detects the outside air temperature at the installation place of the air conditioner 200.

In the refrigerant-amount determination kit 100 of the present embodiment, the server 30 performs refrigerant-amount determination based on the value of the degree of subcooling measured by using the sensor 10 considering the actual measurement value of the outside air temperature. Therefore, the refrigerant-amount determination kit 100 of the present embodiment is able to perform refrigerant-amount determination with high accuracy.

Second Embodiment

Figure 4:
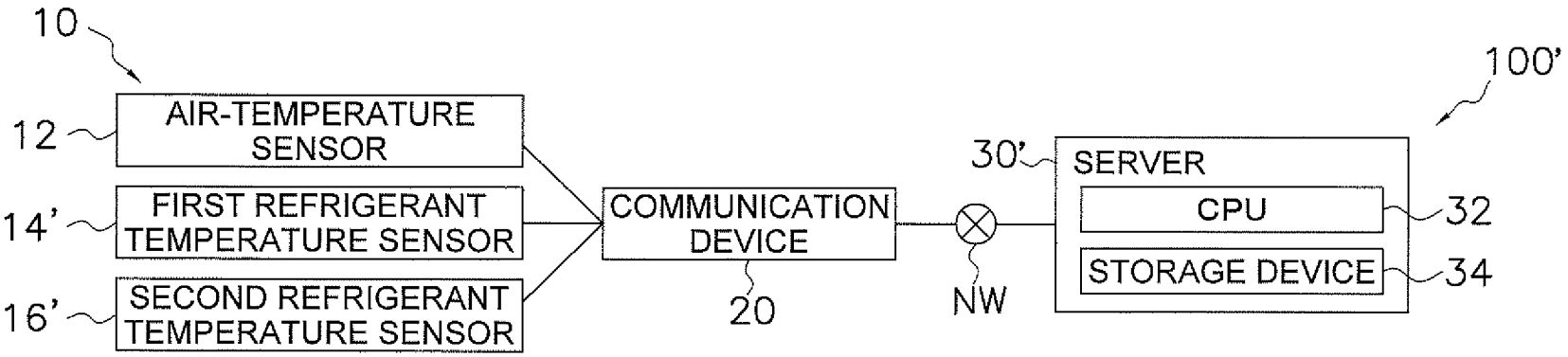
FIG. 4 is a block diagram of a refrigerant-amount determination kit according to a second embodiment of the present disclosure.
Figure 5:
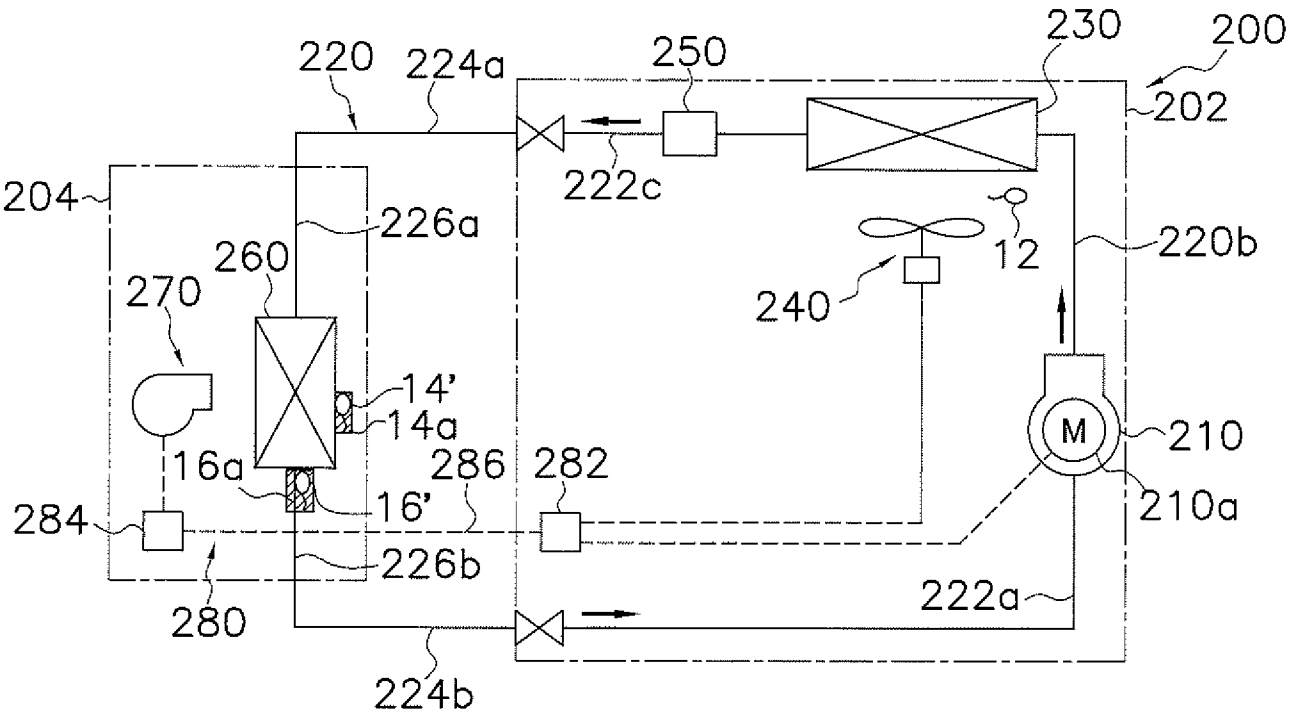
FIG. 5 illustrates a state in which sensors of the refrigerant-amount determination kit in FIG. 4 are installed in a utilization-side heat exchanger, a gas-refrigerant pipe connected to the utilization-side heat exchanger, and a measurement place of a heat-source air temperature of an air conditioner that is a target of refrigerant-amount determination.
Figure 6:
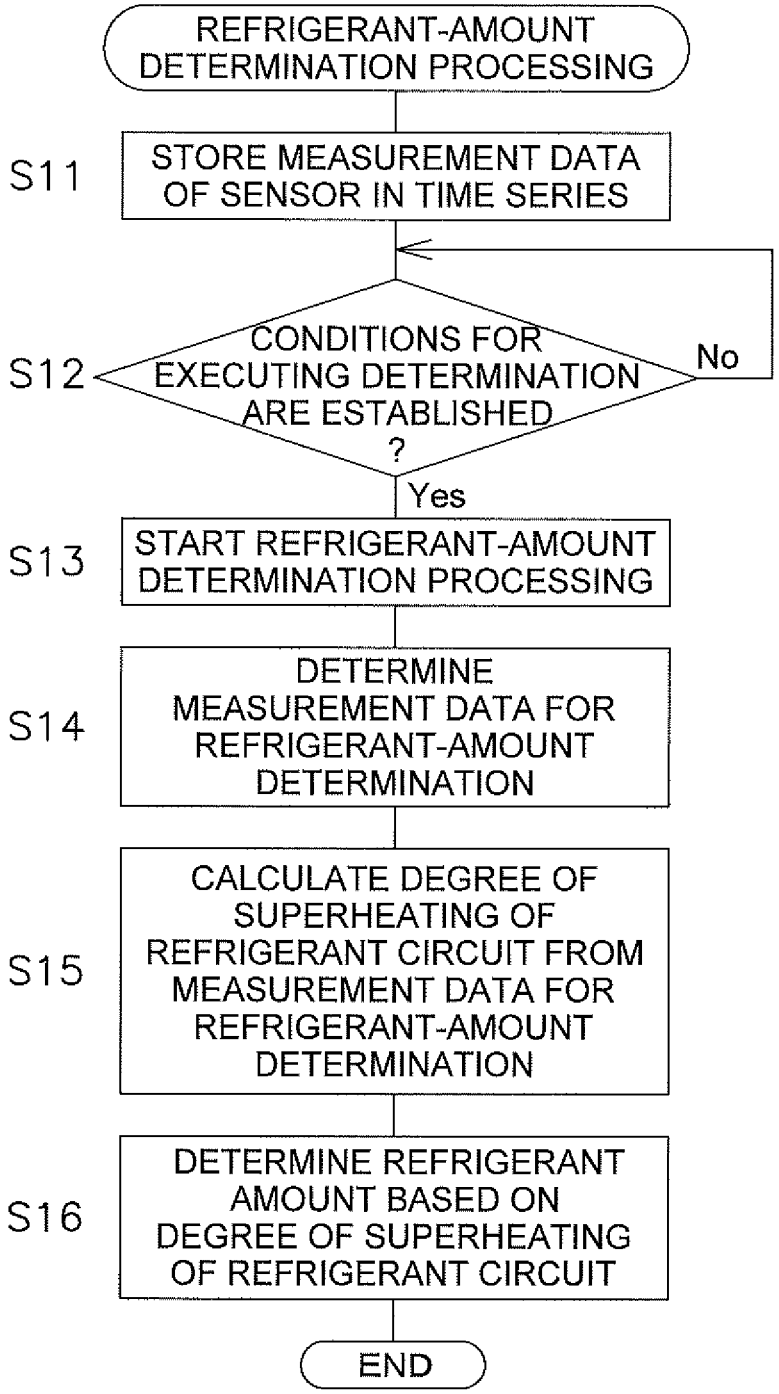
FIG. 6 is an example of the flowchart of processing of refrigerant-amount determination of an air conditioner by the refrigerant-amount determination kit in FIG. 4.

A refrigerant-amount determination kit 100' of a second embodiment will be described with reference to FIG. 4 to FIG. 6. FIG. 4 is a block diagram of the refrigerant-amount determination kit 100'. FIG. 5 is a schematic block diagram of the air conditioner 200. FIG. 5 is similar to FIG. 2 except for the attached position of the sensor 10 of the refrigerant-amount determination kit 100'. FIG. 6 is an example of the flowchart of refrigerant-amount determination processing of the air conditioner 200 performed by the refrigerant-amount determination kit 100'.

The refrigerant-amount determination kit 100' of the second embodiment is similar to the refrigerant-amount determination kit 100 of the first embodiment except for the position at which a first refrigerant temperature sensor 14' and a second refrigerant temperature sensor 16' are mounted on the air conditioner 200 and the refrigerant-amount determination processing of a server 30'. Description here will be thus provided mainly on the difference between the refrigerant-amount determination kit 100' of the second embodiment and the refrigerant-amount determination kit 100 of the first embodiment, and description about features common therebetween are omitted. Description of the air conditioner 200 for which refrigerant-amount determination is to be performed by the refrigerant-amount determination kit 100' is omitted here because the air conditioner 200 has already been described in the first embodiment.

(1) Sensor

In the present embodiment, the sensor 10 includes the air temperature sensor 12, the first refrigerant temperature sensor 14', and the second refrigerant temperature sensor 16'.

The air temperature sensor 12 is similar to the air temperature sensor 12 of the first embodiment. The first refrigerant temperature sensor 14' and the second refrigerant temperature sensor 16' are similar to the first refrigerant temperature sensor 14 and the second refrigerant temperature sensor 16 of the first embodiment respectively except for installation positions thereof with respect to the air conditioner 200. Hereinafter, the first refrigerant temperature sensor 14' and the second refrigerant temperature sensor 16' are sometimes referred to as a second sensor group 15'.

The first refrigerant temperature sensor 14' and the second refrigerant temperature sensor 16' constituting the second sensor group 15' are each mounted on a portion of the air conditioner 200.

In the present embodiment, the first refrigerant temperature sensor 14' is mounted on the utilization-side heat exchanger 260 (refer to FIG. 5). For example, the first refrigerant temperature sensor 14' is mounted on a heat transfer tube (not illustrated) of the utilization-side heat exchanger 260 (refer to FIG. 5). The first refrigerant temperature sensor 14' measures the temperature of the refrigerant flowing in the utilization-side heat exchanger 260. In other words, the first refrigerant temperature sensor 14' detects the evaporation temperature of the refrigerant in the refrigerant circuit 220.

In the present embodiment, the second refrigerant temperature sensor 16' is mounted on the gas-refrigerant pipe 226*b* of the utilization unit 204 (refer to FIG. 5). The second refrigerant temperature sensor 16' measures the temperature of a refrigerant flowing in the gas-refrigerant pipe 226*b*. In other words, the second refrigerant temperature sensor 16' detects the temperature of the refrigerant at an outlet of the utilization-side heat exchanger 260 as an evaporator of the refrigerant circuit 220.

As with the first embodiment, the first refrigerant temperature sensor 14' and the second refrigerant temperature sensor 16' are preferably provided with the heat insulation members 14*a* and 16*a*, respectively.

(2) Server

The server 30' has a physical configuration identical to that in the first embodiment and partly differs from the first embodiment in terms of only an operation as a determination device. The operation of the server 30' as a determination device will be described with reference to the flowchart in FIG. 6.

In the server 30', the measurement data of the air temperature sensor 12, the first refrigerant temperature sensor 14', and the second refrigerant temperature sensor 16' transmitted from the communication device 20 is stored in the storage device 34 as time-series data (step S11).

Next, when determined that conditions for executing refrigerant-amount determination are established (Yes in the Step S12), the server 30' starts determination of the amount of the refrigerant in the refrigerant circuit 220 of the air conditioner 200 (step S13). The conditions for executing refrigerant-amount determination are identical to those in the first embodiment, and thus, description thereof is omitted.

Next, the server 30' determines the measurement data to be used in refrigerant-amount determination, for example, as follows (step S14).

First, the server 30' identifies measurement data during operation of the air conditioner 200 among measurement data of the air temperature sensor 12, the first refrigerant temperature sensor 14', and the second refrigerant temperature sensor 16' during a latest predetermined period, the measurement data being stored in the storage device 34. For example, the server 30' identifies measurement data during operation of the air conditioner 200 among the measurement data of the sensors 12, 14', and 16' during latest one hour, the measurement data being stored in the storage device 34. For example, the server 30' determines the measurement data of the sensors 12, 14', and 16' at a time point when a temperature measured by the first refrigerant temperature sensor 14' is lower than a predetermined temperature as the measurement data during operation of the air conditioner 200. The method by which the server 30' identifies measurement data during operation of the air conditioner 200 among the measurement data of the sensors 12, 14', and 16' is merely an example. The identification method may be selected, as appropriate, as with the first embodiment.

Further, the server 30' identifies measurement data of the sensors 12, 14', and 16' during stable operation among the measurement data of the sensors 12, 14', and 16' during operation of the air conditioner 200. Here, "during stable operation" means a period during which an evaporation temperature measured by the first refrigerant temperature sensor 14' or the temperature of the refrigerant measured by the second refrigerant temperature sensor 16' has little fluctuation. The server 30' determines the measurement data of the sensors 12, 14', and 16' during stable operation of the air conditioner 200 as measurement data of the sensors 12, 14', and 16' to be used in refrigerant-amount determination.

Next, the server 30' calculates the degree of superheating in the refrigeration cycle by using a measurement value of the first refrigerant temperature sensor 14' and a measurement value of the second refrigerant temperature sensor 16' in the air conditioner 200 during stable operation (step S15). Specifically, the server 30' calculates the degree of superheating by subtracting the measurement value of the first refrigerant temperature sensor 14' from the measurement value of the second refrigerant temperature sensor 16'. When the measurement data of the sensors 12, 14', and 16' during stable operation of the air conditioner 200 includes measurement data at a plurality of time points, an average value, an intermediate value, or the like of the degrees of superheating at the plurality of time points may be calculated as the degree of superheating.

Next, the server 30' determines the refrigerant amount of the refrigerant circuit 220 based on an outside air temperature, which is a measurement value of the air temperature sensor 12 during stable operation of the air conditioner 200, and the degree of superheating calculated in the step S15 (step S16). When the measurement data of the sensors 12, 14', and 16' during stable operation of the air conditioner 200 includes measurement data at a plurality of time points, the server 30' may use, as the outside air temperature, an average value, an intermediate value, or the like of outside air temperatures at the plurality of time points. For example, when the measurement data of the sensors 12, 14', and 16' during stable operation of the air conditioner 200 includes measurement data at a plurality of time points, the server 30' may determine the refrigerant amount of the refrigerant circuit 220 based on the average value of outside air temperatures at the plurality of time points and the average value of the degrees of superheating at the plurality of time points.

An example of the refrigerant-amount determination method will be described in detail.

The storage device 34 of the server 30' stores a table or a formula in which the outside air temperature and a reference degree of superheating of the refrigerant circuit 220 of the air conditioner 200, which is a degree of superheating when the refrigerant amount of the refrigerant circuit 220 is proper, are in association with each other. For example, the table or formula in which the outside air temperature and the reference degree of superheating are in association with each other may be theoretically calculated, or may be obtained based on a result of operation using an experimental apparatus of the air conditioner. The table or the formula in which the outside air temperature and the reference degree of superheating are in association with each other may be generated by the server 30' based on the data that has been collected by using a sensor 10' during the past actual operation of the air conditioner 200 for which evaluation of the refrigerant amount is to be performed. The table or the formula in which an outside air temperature and the reference degree of superheating are in association with each other may be generated by the server 30' based on the data of past actual operation of an air conditioner that differs from the air conditioner 200 for which evaluation of the refrigerant amount is to be performed.

The server 30' determines that the refrigerant amount of the refrigerant circuit 220 is small, for example, when the degree of superheating calculated in the step S15 is larger than the value of (reference degree of superheating+tolerance). When the degree of superheating calculated in the step S15 is less than or equal to the value of (reference degree of superheating+tolerance), the server 30' determines that the refrigerant amount of the refrigerant circuit 220 is proper amount.

As with the server 30 of the first embodiment, when determined that the refrigerant amount of the air conditioner 200 is small, the server 30' preferably reports the determination that the refrigerant amount of the air conditioner 200 is small to an operator of the refrigerant-amount determination kit 100, a user of the air conditioner 200, or the like.

The aforementioned flow of refrigerant-amount determination processing is merely an example. For example, according to the above description, the server 30' performs refrigerant-amount determination by using previously acquired measurement data of the sensors 12, 14', and 16'. As an alternative to this, the server 30' may perform refrigerant-amount determination by using measurement data of the sensors 12, 14', and 16' acquired after the conditions for executing the determination are established (after Yes is determined in the step S12).

(3) Features

The refrigerant-amount determination kit 100' of the second embodiment has features similar to those in (4-1) to (4-3) of the refrigerant-amount determination kit 100 of the first embodiment. In addition, the refrigerant-amount determination kit 100' of the second embodiment has following features.

In the refrigerant-amount determination kit 100' of the second embodiment, the sensor 10' includes the second sensor group 15'. The second sensor group 15' includes the first refrigerant temperature sensor 14' and the second refrigerant temperature sensor 16'. The first refrigerant temperature sensor 14' detects the evaporation temperature of the refrigerant in the refrigerant circuit 220. The second refrigerant temperature sensor 16' detects the temperature of the refrigerant at the outlet of the utilization-side heat exchanger 260, which functions as an evaporator of the refrigerant circuit 220.

In the refrigerant-amount determination kit 100' of the present embodiment, it is possible to perform refrigerant-amount determination with high accuracy by utilizing the value of the degree of subheating measured by using the sensor 10'.

In particular, in the refrigerant-amount determination kit 100' of the second embodiment, the sensor 10' includes the air temperature sensor 12 that detects the outside air temperature at the installation place of the air conditioner 200.

In addition, in the refrigerant-amount determination kit 100' of the present embodiment, the server 30' performs refrigerant-amount determination based on the value of the degree of superheating measured by using the sensor 10' considering the actual measurement value of the outside air temperature. Therefore, the refrigerant-amount determination kit 100' of the present embodiment is able to perform refrigerant-amount determination with high accuracy.

<Modifications>

Modifications of the aforementioned embodiments will be described. The following modifications may be combined together, as appropriate, within a scope that causes no inconsistency.

(1) Modification A

In the aforementioned embodiments, the refrigerant-amount determination kits 100 and 100' have the sensors 10 and 10' and the servers 30 and 30' connected to the sensors 10 and 10' through the network NW, respectively; the configurations of the refrigerant-amount determination kits 100 and 100' are, however, not limited thereto.

Figure 7:
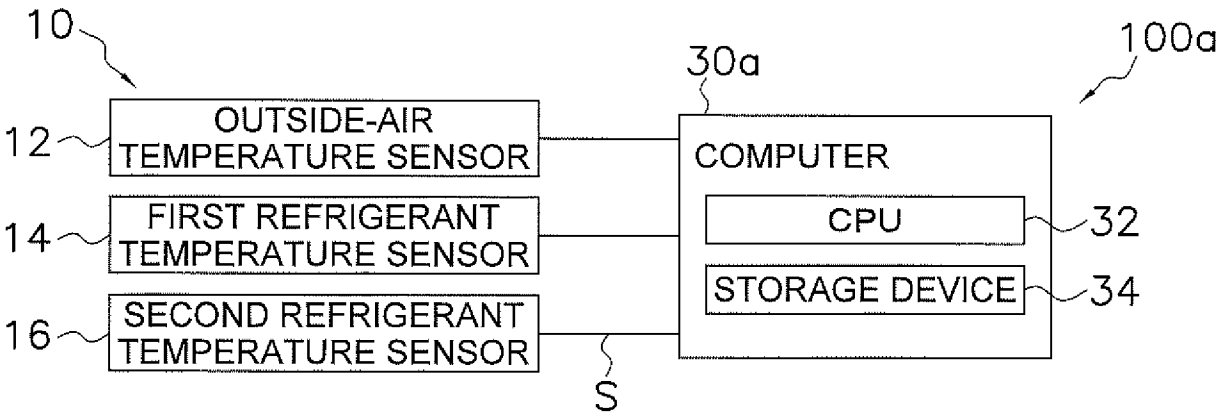
FIG. 7 is a block diagram of a refrigerant-amount determination kit according to a modification A of the present disclosure.

For example, as illustrated in FIG. 7, a refrigerant-amount determination kit 100*a* may have the sensor 10 and a local computer 30*a* that has a function similar to that of the server 30 of the aforementioned embodiments. The computer 30*a* may be a mobile terminal, such as a smartphone. In the present modification, the computer 30*a* is connected to the sensor 10 through a signal line S, not through the network NW. The sensor 10 and the computer 30*a* may be communicably connected to each other through a wireless network, not through the physical signal line S.

The sensor 10 and the computer 30*a* are not limited to being communicably connected to each other. For example, measurement data of the sensor 10 may be inputted into the computer 30*a* by utilizing a medium, such as a memory card.

(2) Modification B

In the aforementioned embodiments, the refrigerant-amount determination kits 100 and 100' each have the air temperature sensor 12 and measure the outside air temperature at the installation place of the air conditioner 200 by using the air temperature sensor 12.

Figure 8:
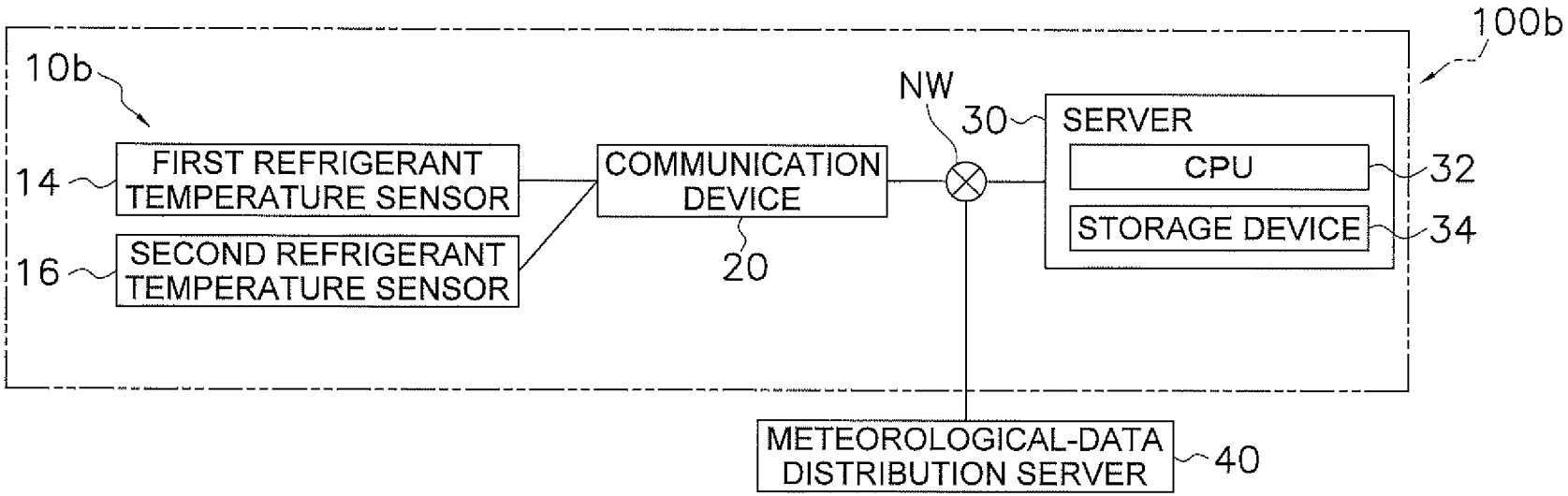
FIG. 8 is a block diagram of a refrigerant-amount determination kit according to a modification B of the present disclosure.

As illustrated in FIG. 8, a refrigerant-amount determination kit 100*b* may not include the air temperature sensor 12. The server 30 of the refrigerant-amount determination kit 100*b* is connected through the network NW, such as the Internet, to a meteorological-data distribution server 40 that distributes meteorological data. The server 30 of the refrigerant-amount determination kit 100*b* uses, as an alternative to the outside air temperature measured by the air temperature sensor 12, an outside air temperature distributed by the meteorological-data distribution server 40 in refrigerant-amount determination.

In addition, in another form, the server of the refrigerant-amount determination kit may use an outside air temperature inputted by a person in refrigerant-amount determination.

(3) Modification C

In the aforementioned embodiments, the refrigerant-amount determination kit 100 has the two refrigerant temperature sensors 14 and 16, and the refrigerant-amount determination kit 100' has the two refrigerant temperature sensors 14' and 16'.

The refrigerant-amount determination kits are, however, not limited thereto and may have a single refrigerant temperature sensor. For example, the single refrigerant temperature sensor is a sensor that detects the condensation temperature in the heat-source-side heat exchanger 230. In this case, the storage device of the server of the refrigerant-amount determination kit stores a table or a formula in which the outside air temperature and tendency of the temperature change of the condensation temperature of the air conditioner 200 when the refrigerant amount is proper are in association with each other. The server of the refrigerant-amount determination kit performs refrigerant-amount determination by comparing a change in the condensation temperature during operation of the air conditioner 200, the change being obtained from a measurement result of the single refrigerant temperature sensor, with the tendency of the temperature change of the condensation temperature stored in the storage device.

The refrigerant-amount determination kit may perform refrigerant-amount determination by using a plurality of indicators (for example, the degree of subcooling, the degree of superheating, condensation temperature, evaporation temperature, and the like) obtained by using measurement data of three or more refrigerant temperature sensors.

(4) Modification D

In the aforementioned embodiments, the refrigerant-amount determination kits 100 and 100' calculate, based on the measurement result of the sensor 10 or 10', the degree of subcooling and the degree of superheating respectively in the air conditioner 200 that performs cooling of the air conditioned space and each performs refrigerant-amount determination based on the calculated value.

The refrigerant-amount determination kits 100 and 100' are, however, not limited thereto and may calculate, based on the measurement result of the sensor 10 or 10', the degree of subcooling and the degree of superheating respectively in an air conditioner that performs heating of the air conditioned space and may each perform refrigerant-amount determination based on the calculated value. In other words, the refrigerant-amount determination kits 100 and 100' may calculate the degree of subcooling or the degree of superheating in an air conditioner that causes the utilization-side heat exchanger 260 to function as an evaporator and the heat-source-side heat exchanger 230 to function as an evaporator and may each perform refrigerant-amount determination based on the calculated value.

(5) Modification E

In the aforementioned embodiments, the refrigerant-amount determination kits 100 and 100' utilize the degree of subcooling or the degree of superheating, and the measurement value of the air temperature sensor 12 in refrigerant-amount determination processing. The refrigerant-amount determination kits 100 and 100' are, however, not limited by such a form and not limited to having the air temperature sensor 12. The servers 30 and 30' of the refrigerant-amount determination kits 100 and 100' may each perform refrigerant-amount determination based on a result of comparison of the degree of subcooling or the degree of superheating with a predetermined reference value that does not depend on an outside air temperature.

<Additional Remark>

Although embodiments of the present disclosure have been described above, it should be understood that the form and details thereof can be variously changed without deviating from the spirit and the scope of the present disclosure.

What is claimed is:

1. A refrigerant-amount determination kit comprising:

a temperature sensor that is mounted at least temporarily on a portion of a refrigeration cycle apparatus having a refrigerant circuit that includes a compressor, a condenser, and an evaporator, the temperature sensor being configured to detect a temperature of a refrigerant flowing in the refrigerant circuit;

a heat insulation member that covers a periphery of the temperature sensor;

a processor configured to determine an amount of a refrigerant in the refrigerant circuit based on a detection result detected by the temperature sensor during operation of the refrigeration cycle apparatus and acquire an outside air temperature at an installation place of the refrigeration cycle apparatus; and a memory, the temperature sensor including at least one of a first sensor group that includes a first temperature sensor configured to detect a condensation temperature of the refrigerant in the refrigerant circuit and a second temperature sensor configured to detect a temperature of the refrigerant at an outlet of the condenser of the refrigerant circuit, and a second sensor group that includes a third temperature sensor configured to detect an evaporation temperature of the refrigerant in the refrigerant circuit and a fourth temperature sensor configured to detect a temperature of the refrigerant at an outlet of the evaporator of the refrigerant circuit, the processor being configured to calculate a degree of subcooling by using a measurement value of the first refrigerant temperature sensor and a measurement value of the second refrigerant temperature sensor identified during a stable operation of the refrigeration cycle apparatus, or a degree of superheating by using a measurement value of the third refrigerant temperature sensor and a measurement value of the fourth refrigerant temperature sensor identified during the stable operation of the refrigeration cycle apparatus, the memory being configured to store reference degrees of subcooling, which are degrees of subcooling when the refrigerant amount of the refrigerant circuit is proper, in association with the outside air temperature or reference degrees of superheating, which are degrees of superheating when the refrigerant amount of the refrigerant circuit is proper, in association with the outside air temperature, and the processor being configured to determine whether the amount of the refrigerant in the refrigerant circuit is proper by comparing the calculated degree of subcooling with the reference degree of subcooling associated with the acquired outdoor temperature, or determine whether the amount of the refrigerant in the refrigerant circuit is proper by comparing the calculated degree of superheating with the reference degree of superheating associated with the acquired outdoor temperature, wherein the first temperature sensor of the first sensor group is mounted on a heat transfer tube of the condenser, the second temperature sensor of the first sensor group is mounted on a refrigerant pipe of the refrigerant circuit, the third temperature sensor of the second sensor group is mounted on a heat transfer tube of the evaporator, and the fourth temperature sensor of the second sensor group is mounted on a refrigerant pipe of the refrigerant circuit.

2. The refrigerant-amount determination kit according to claim 1, further comprising an outside-air temperature sensor configured to detect the outside air temperature at the installation place of the refrigeration cycle apparatus, wherein the processor is configured to acquire the outside air temperature from the outside-air temperature sensor.

3. The refrigerant-amount determination kit according to claim 1, further comprising:

a transmitter configured to transmit the detection result detected during operation of the refrigeration cycle apparatus by the temperature sensor to the processor.

4. The refrigerant-amount determination kit according to claim 2, further comprising:

a transmitter configured to transmit the detection result detected during operation of the refrigeration cycle apparatus by the temperature sensor to the processor.

5. The refrigerant-amount determination kit according to claim 1, wherein the compressor is a constant-speed compressor.

6. The refrigerant-amount determination kit according to claim 2, wherein the compressor is a constant-speed compressor.

7. The refrigerant-amount determination kit according to claim 3, wherein the compressor is a constant-speed compressor.

* * * * *